United States Patent [19]

Sequeira, Jr. et al.

[11] 4,169,016

[45] Sep. 25, 1979

[54] CONTROL SYSTEM FOR A FURFURAL REFINING UNIT RECEIVING LIGHT SWEET CHARGE OIL

[75] Inventors: Avilino Sequeira, Jr.; John D. Begnaud; Frank L. Barger, all of Port Arthur, Tex.

[73] Assignee: Texaco Inc., White Plains, N.Y.

[21] Appl. No.: 912,910

[22] Filed: Jun. 5, 1978

Related U.S. Application Data

[63] Continuation of Ser. No. 851,998, Nov. 16, 1977, abandoned.

[51] Int. Cl.[2] ..... C10G 21/00; C06G 7/58

[52] U.S. Cl. ..... 196/14.52; 364/497; 364/501; 422/62

[58] Field of Search ..... 196/14.52; 23/253 A, 23/230 A; 364/497, 501

[56] References Cited

U.S. PATENT DOCUMENTS

| | | | |
|---|---|---|---|
| 3,799,871 | 3/1974 | Sequeira, Jr. | 196/14.52 |
| 3,911,259 | 10/1975 | Huddleston et al. | 364/501 |
| 3,972,779 | 3/1976 | Harrison | 196/14.52 |
| 4,053,744 | 10/1977 | Woodle | 196/14.52 |

*Primary Examiner*—R. E. Serwin

*Attorney, Agent, or Firm*—Thomas H. Whaley; Carl G. Ries; Ronald G. Gillespie

[57] ABSTRACT

A furfural refining unit treats light sweet charge oil with a furfural solvent in a refining tower to yield raffinate and extract mix. The furfural is recovered from the raffinate and from the extract mix and returned to the refining tower. A system controlling the refining unit includes a gravity analyzer, a flash point temperature analyzer, a sulfur analyzer, and viscosity analyzers; all analyzing the light sweet charge oil and providing corresponding signals, sensors sense the flow rates of the charge oil and the furfural flowing into the refining tower and the temperature of the extract mix and provide corresponding signals. One of the flow rates of the light sweet charge oil and the furfural flow rates is controlled in accordance with the signals from all the analyzers and all the sensors, while the other flow rate of the light sweet charge oil and the furfural flow rates is constant.

9 Claims, 13 Drawing Figures

CONTROL SYSTEM FOR A FURFURAL REFINING UNIT RECEIVING LIGHT SWEET CHARGE OIL

CROSS REFERENCE TO RELATED APPLICATIONS

This application is a continuation as to all subject matter common to U.S. application Ser. No. 851,998, filed Nov. 16, 1977, and now abandoned, by Avilino Sequeira, Jr., John D. Begnaud and Frank L. Barger, and assigned to Texaco Inc., assignee of the present invention, and a continuation-in-part for additional subject matter.

BACKGROUND OF THE INVENTION

FIELD OF THE INVENTION

The present invention relates to control systems and methods in general and, more particularly, to control systems and methods for oil refining units.

SUMMARY OF THE INVENTION

A furfural refining unit treats light sweet charge oil with a furfural solvent in a refining tower to yield raffinate and extract mix. The furfural is recovered from the raffinate and from the extract mix and returned to the refining tower. A system controlling the refining unit includes a gravity analyzer, a flash point temperature analyzer, a sulfur analyzer, and viscosity analyzers. The analyzers analyze the light sweet charge oil and provide corresponding signals. Sensors sense the flow rates of the charge oil and the furfural flowing into the refining tower and the temperature of the extract-mix and provide corresponding signals. The flow rate of the light sweet charge oil or the furfural is controlled in accordance with the signals provided by all the sensors and the analyzers while the other flow rate of the light sweet charge oil or the furfural is constant.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

Figure 1:
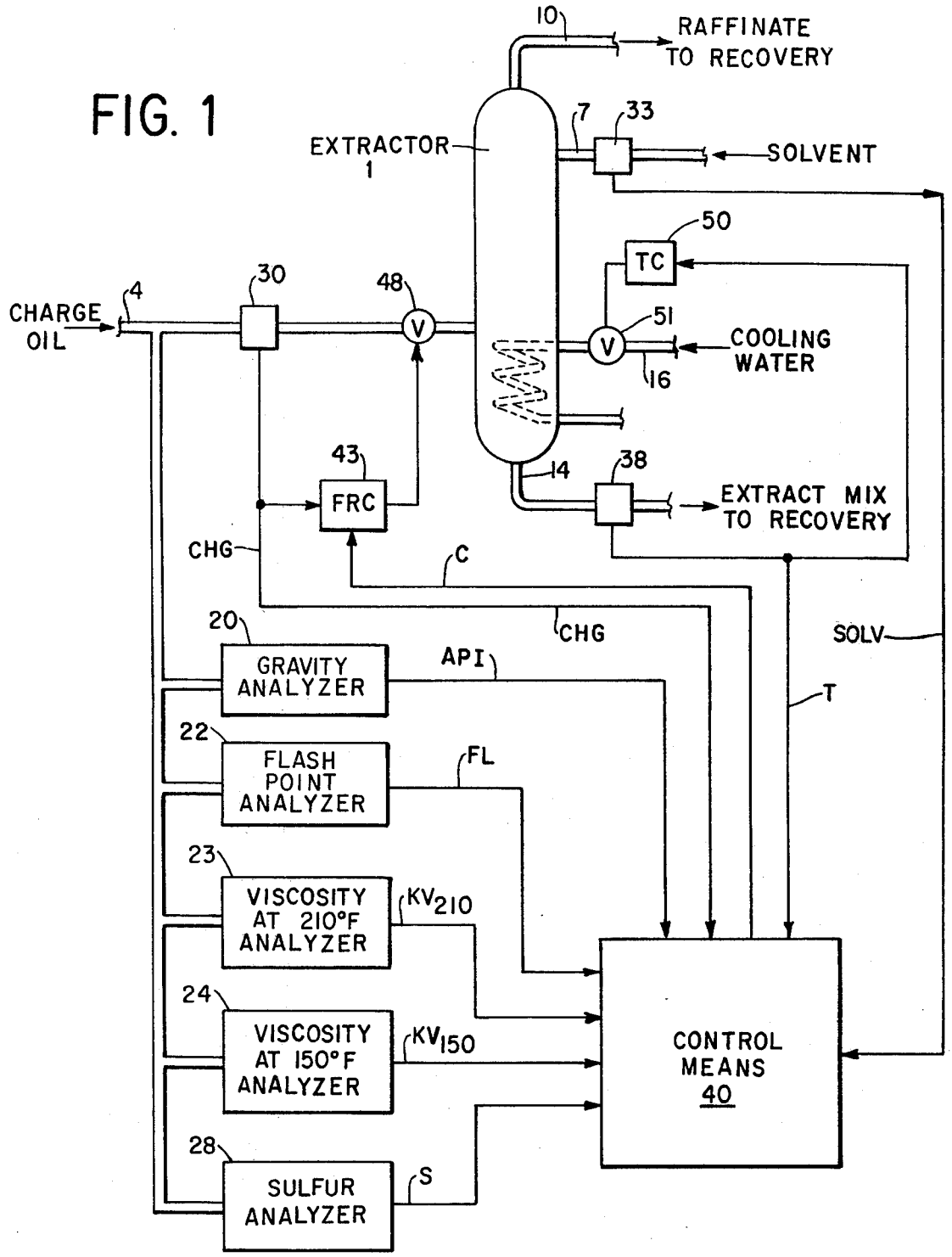
FIG. 1 shows a furfural refining unit in partial schematic form and a control system, constructed in accordance with the present invention, in simple block diagram form.

An extractor 1 in a furfural refining unit is receiving light sweet charge oil by way of a line 4 and furfural solvent by way of a line 7 and providing raffinate to recovery by way of a line 10, an extract mix to recovery by way of a line 14.

Light sweet charge oil is a charge oil having a sulfur content equal to or less than a predetermined sulfur content and having a kinematic viscosity, corrected to a predetermined temperature, less than a predetermined kinematic viscosity. Preferably, the predetermined sulfur content is 1.0%, the predetermined temperature is 210° F., and the predetermined kinematic viscosity is 7.0. The temperature in extractor 1 is controlled by cooling water passing through a line 16. A gravity analyzer 20, flash point analyzer 22 and viscosity analyzers 23 and 24, and a sulfur analyzer 28 sample the charge oil in line 4 and provide signals API, FL, $KV_{210}$, $KV_{150}$ and S, respectively, corresponding to the API gravity, the flash point, the kinematic viscosities at 210° F. and 150° F., and sulfur content, respectively.

A flow transmitter 30 in line 4 provide a signal CHG corresponding to the flow rate of the charge oil in line 4. Another flow transmitter 33 in line 7 provides a signal SOLV corresponding to the furfural flow rate. A temperature sensor 38, sensing the temperature of the extract mix leaving extractor 1, provides a signal T corresponding to the sensed temperature. All signals hereinbefore mentioned are provided to control means 40.

Control means 40 provides signal C to a flow recorder controller 43. Recorder controller 43 receives signals CHG and C and provides a signal to a valve 48 to control the flow rate of the charge oil in line 4 in accordance with signals CHG and C so that the charge oil assumes a desired flow rate. Signal T is also provided to temperature controller 50. Temperature controller 50 provides a signal to a valve 51 to control the amount of cooling water entering extractor 1 and hence the temperature of the extract-mix in accordance with its set point position and signal T.

The following equations are used in practicing the present invention for light sweet charge oil:

$$H_{210}=\ln\ln(KV_{210}+C_1) \qquad 1.$$

where $H_{210}$ is a viscosity H value for 210° F., $KV_{210}$ is the kinematic viscosity of the charge oil at 210° F. and $C_1$ is a constant having a preferred value of 0.6

$$H_{150}=\ln\ln(KV_{150}+C_1) \qquad 2.$$

where $H_{150}$ is a viscosity H value for 150° F., and $KV_{150}$ is the kinematic viscosity of the charge oil at 150° F.

$$K_{150}=[C_2-1\ \mathrm{n}(T_{150}+C_3]/C_4 \qquad 3.$$

where $K_{150}$ is a constant needed for estimation of the kinematic viscosity at 100° F., $T_{150}$ is 150, and $C_2$ through $C_4$ are constants having preferred values of 6.5073, 460 and 0.17937, respectively.

$$H_{100}=H_{210}+(H_{150}-H_{210})/K_{150} \qquad 4.$$

where $H_{100}$ is a viscosity H value for 100° F.

$$KV_{100}=\exp[\exp(H_{100})]-C_1 \qquad 5.$$

where $KV_{100}$ is the kinematic viscosity of the charge oil at 100° F.

$$SUS=C_5(KV_{210})+[C_6+C_7(KV_{210})]/[C_8+C_9(KV_{210})+C_{10}(KV_{210})^2+C_{11}(KV_{210})^3](C_{12}) \qquad 6.$$

where SUS is the viscosity in Saybolt Universal Seconds and $C_5$ through $C_{12}$ are constants having preferred values of 4.6324, 1.0, 0.03264, 3930.2, 262.7, 23.97, 1.646 and $10^{-5}$, respectively.

$$SUS_{210}=[C_{13}+C_{14}(C_{15}-C_{16})]SUS \quad 7.$$

where $SUS_{210}$ is the viscosity in Saybolt Universal Seconds at 210° F. and $C_{13}$ through $C_{16}$ are constants having preferred values of 1.0, 0.000061, 210 and 100, respectively.

$$VI_{DWCO}=C_{17}-C_{18}(FL)+C_{19}(VI)+C_{20}(KV_{210})(API) \quad 8.$$

where $VI_{DWCO}$, FL, VI, and API are the viscosity index of the dewaxed charge at zero pour point, the flash point temperature of the charge oil, the viscosity index of the charge oil and the API gravity of the charge oil, respectively, and $C_{12}$ through $C_{20}$ are constants having preferred values of 27.35, 0.1159, 0.69819 and 0.21112, respectively.

$$VI_{DWCP}=VI_{DWCO}+(POUR)[C_{21}-C_{22}\ln SUS_{210}+C_{23}(\ln SUS_{210})^2] \quad 9.$$

here $VI_{DWCP}$ and Pour are the viscosity index of the dewaxed product at a predetermined temperature and the Pour Point of the dewaxed charge respectively, and $C_{21}$ through $C_{23}$ are constants having preferred values of 2.856, 1.18 and 0.126, respectively.

$$\Delta VI=VI_{RO}-V_{DWCO}=VI_{RP}-VI_{DWCP} \quad 10.$$

where $VI_{RO}$ and $VI_{RP}$ are the VI of the refined oil at 0° F., and the predetermined temperature, respectively.

$$A=C_{24}-C_{25}(5)-C_{26}(5)^2+C_{27}(KV_{210})(API)-C_{28}(KV_{210})(VI)+C_{29}(FL)(API)+C_{30}(FL)+C_{31}(FL)(VI) \quad 11.$$

where S is the percent sulfur in the charge oil and $C_{24}$ through $C_{31}$ are constants having preferred values of 434.074, 88.98932, 22.6125, 3.17397, 1.3905, 0.05033, 0.51586 and 0.01388.

$$J=\{\{C_{32}-C_{33}A+\{[C_{33}A-C_{32}]^2-4[C_{34}-C_{35}A][-C_{36}+C_{37}\sqrt{T}-\Delta_{38}(A)(\sqrt{T})-\Delta VI]\}^{\frac{1}{2}}\}/2[C_{34}-C_{35}(A)]\}^2 \quad 12.$$

where J is the furfural dosage and $C_{32}$ through $C_{38}$ are constants having preferred values of 15.762, 0.075007, 0.25747, 0.0012087, 5.2479, 14.096 and 0.056338.

$$C=(SOLV)(100)/J \quad 13.$$

where $C$ is the new charge oil flow rate.

Figure 2:
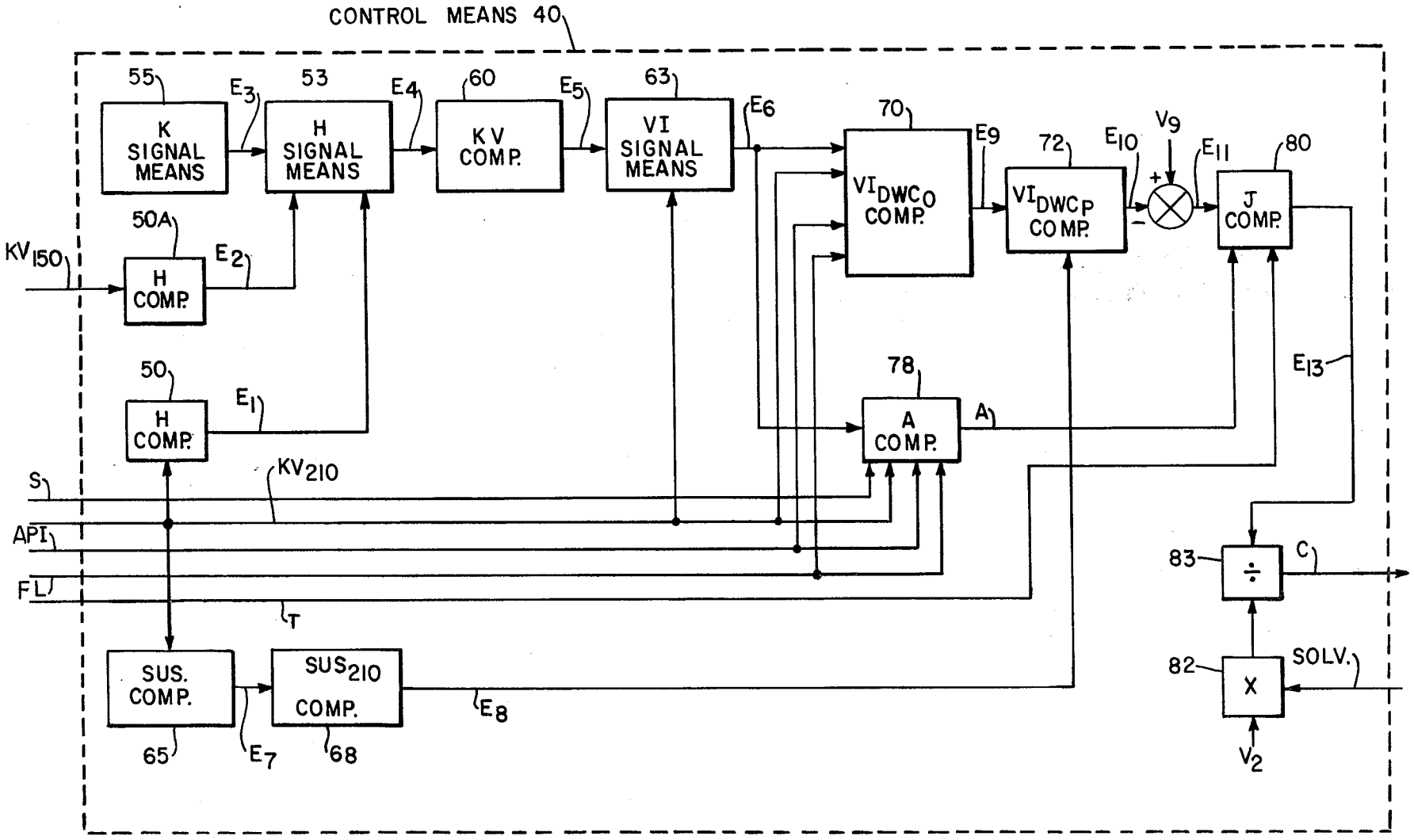
FIG. 2 is a detailed block diagram of the control means shown in FIG. 1.

Referring now to FIG. 2, signal $KV_{210}$ is provided to an H computer 50 in control means 40, while signal $KV_{150}$ is applied to an H computer 50A. It should be noted that elements having a number and a letter suffix are similar in construction and operation as to those elements having the same numeric designation without a suffix. All elements in FIG. 2, except elements whose operation is obvious, will be disclosed in detail hereinafter. Computers 50 and 50A provide signals $E_1$ and $E_2$ corresponding to $H_{210}$ and $H_{150}$, respectively, in equations 1 and 2 respectively, to H signal means 53. K signal means 55 provides a signal $E_3$ corresponding to the term $K_{150}$ in equation 3 to H signal means 53. H signal means 53 provides vides a signal $E_4$ corresponding to the term $H_{100}$ in equation 4 to a KV computer 60 which provides a signal $E_5$ corresponding to term $KV_{100}$ in accordance with signal $E_4$ and equation 5 as hereinafter explained.

Signals $E_5$ and $KV_{210}$ are applied to VI signal means 63 which provides a signal $E_6$ corresponding to the viscosity index.

An SUS computer 65 receives signal $KV_{210}$ and provides a signal $E_7$ corresponding to the term SUS in accordance with the received signals and equation 6 as hereinafter explained.

An SUS 210 computer 68 receives signal $E_7$ and applies signal $E_8$ corresponding to the term $SUS_{210}$ in accordance with the received signal and equation 7 as hereinafter explained.

A $VI_{DWCO}$ computer 70 receives signal $KV_{210}$ API, FL and $E_6$ and provides a signal $E_9$ corresponding to the term $VI_{DWCO}$ in accordance with the received signals and equation 8 as hereinafter explained.

A $VI_{DWCP}$ computer 72 receives signal $E_8$ and $E_9$ and provides a signal $E_{10}$ corresponding to the term $VI_{DWCP}$ in accordance with the received signals and equation 9. Subtracting means 76 performs the function of equation 10 by subtracting signal $E_{10}$ from a direct current voltage $V_9$ corresponding to the term $VI_{RP}$, in equation 10, to provide a signal $E_{11}$ corresponding to the term $\Delta VI$ in equation 10.

An A computer 78 receives signals API, $KV_{210}$, S, FL and $E_6$ and provide a signal $E_{12}$ corresponding to a term A, in accordance with the received signals and equation 11, as hereinafter explained.

A J computer 80 receives signals T, $E_{11}$ and $E_{12}$ and provide a signal $E_{13}$ corresponding to the term J in accordance with the received signals and equation 12 as hereinafter explained to a divider 83.

Signal SOLV is provided to a multiplier 82 where it is multiplied by a direct current voltage $V_2$ corresponding to a value of 100 to provide a signal corresponding to the term (SOLV) (100) in equation 13. The product signal is applied to divider 83 where it is divided by signal $E_{13}$ to provide signal C corresponding to the desired new charge oil flow rate.

It would be obvious to one skilled in the art that if the charge oil flow rate was maintained constant and the furfural flow rate varied, equation 13 would be rewritten as $$SO=(J)(CHG)/100 \quad 14.$$

where SO is the new furfural flow rate. Control means 40 would be modified accordingly.

Figure 3:
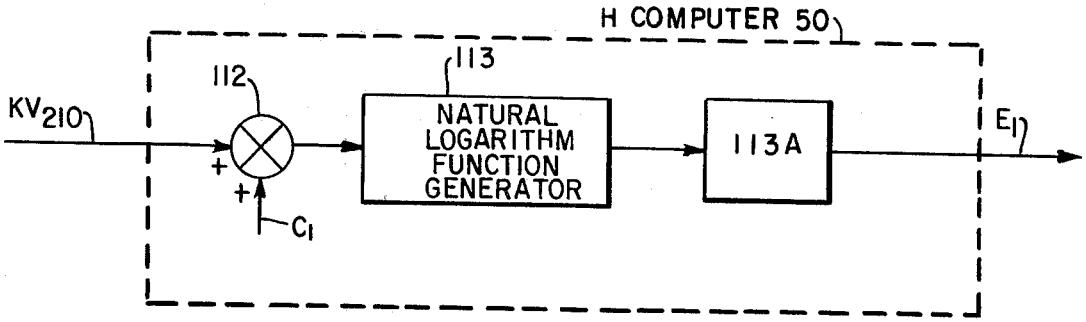
FIGS. 3 through 13 are detailed block diagrams of the H computer, the K signal means, the H signal means, the KV computer, the VI signal means, the SUS computer, the $SUS_{210}$ computer, the $VI_{DWCO}$ computer, the $VI_{DWCP}$ computer, the A computer and the J computer, respectively, shown in FIG. 2.

Referring now to FIG. 3, H computer 50 includes summing means 112 receiving Signal $KV_{210}$and summing it with a direct current voltage $C_1$ to provide a signal corresponding to the term $[KV_{210}+C_1]$ shown in equation 1. The signal from summing means 112 is applied to a natural logarithm function generator 113 which provides a signal corresponding to the natural log of the sum signal which is then applied to another natural log function generator 113A which in turn provides signal $E_{10}$.

Figure 4:
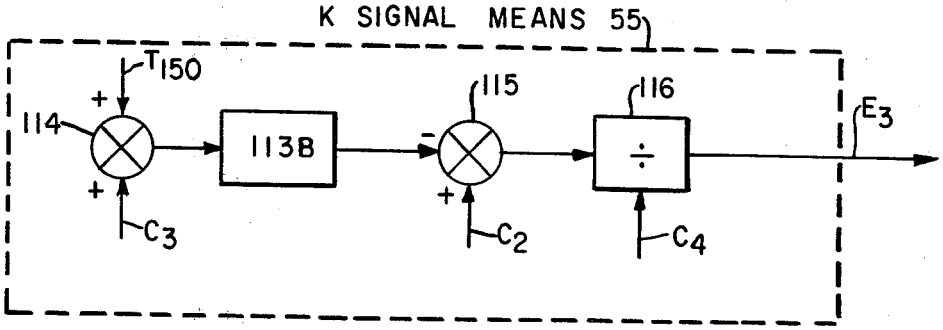

Referring now to FIG. 4, K signal means 55 includes summing means 114 summing direct current voltage $T_{150}$ and $C_3$ to provide a signal corresponding to the term $[T_{150}+C_3]$ which is provided to a natural log function generator 113B which in turn provides a signal corresponding to the natural log of the sum signal from summing means 114. Subtracting means 114 subtracts the signal provided by function generator 113B from a direct current voltage $C_2$ to provide a signal corresponding to the numerator of equation 3. A divider 116 divides the signal from subtracting means 115 with a direct current voltage $C_4$ to provide signal $E_3$.

Figure 5:
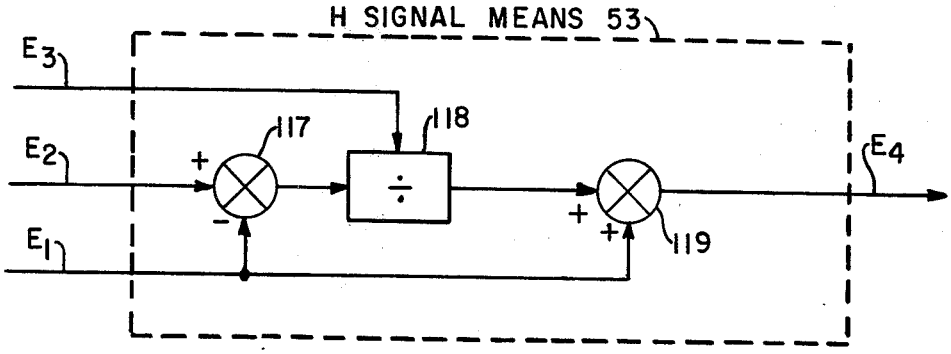

Referring now to FIG. 5, H signal means 53 includes subtracting means 117 which subtracts signal $E_1$ from signal $E_2$ to provide a signal corresponding to the term $H_{150}-H_{210}$, in equation 4, to a divider 118. Divider 118 divides the signal from subtracting means 117 by signal $E_3$. Divider 114 provides a signal which is summed with signal $E_1$ by summing means 119 to provide signal $E_4$ corresponding to $H_{100}$.

Figure 6:
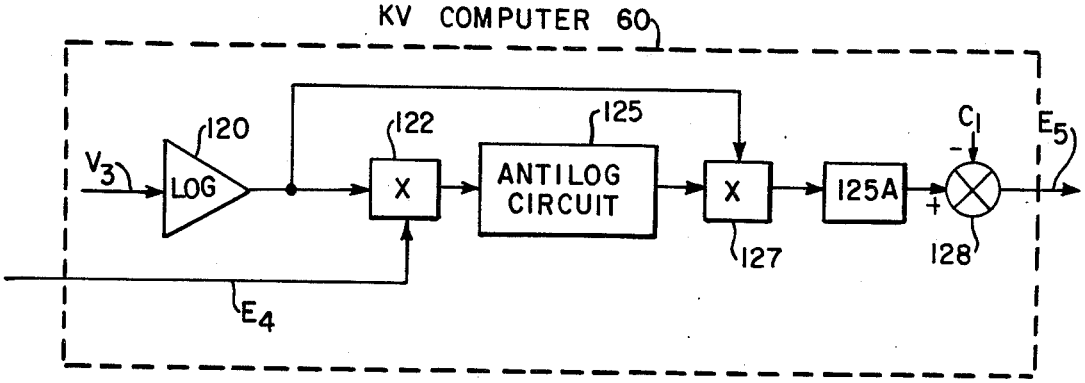

Referring now to FIG. 6, a direct current voltage $V_3$ is applied to a logarithmic amplifier 120 in KV computer 60. Direct current voltage $V_3$ corresponds to the mathematical constant e. The output from amplifier 120 is applied to a multiplier 122 where it is multiplied with signal $E_4$. The product signal from multiplier 122 is applied to an antilog circuit 125 which provides a signal corresponding to the term exp ($H_{100}$) in equation 5. The signal from circuit 125 is multiplied with the output from logarithmic amplifier 120 by a multiplier 127 which provides a signal to antilog circuit 125A. Circuit 125A is provided to subtracting means 128 which subtracts a direct current voltage $C_1$ from the signal from circuit 125A to provide signal $E_5$.

Figure 7:
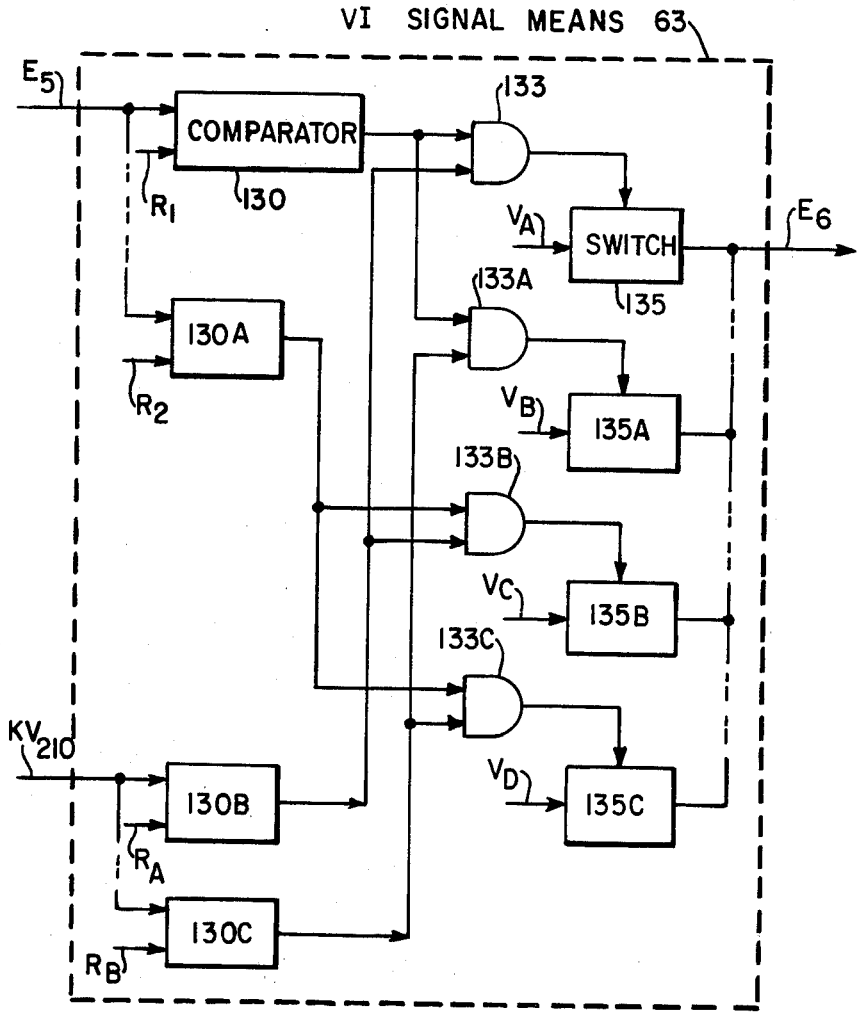

Referring now to FIG. 7, VI signal means 63 is essentially memory means which is addressed by signals $E_5$, corresponding to $KV_{100}$, and signal $KV_{210}$. In this regard, a comparator 130 and comparator 130A represent a plurality of comparators which receive signal $E_5$ and compare signal $E_5$ to reference voltages, represented by voltages $R_1$ and $R_2$, so as to decode signal $E_5$. Similarly, comparators 130B and 130C represent a plurality of comparators receiving signal $KV_{210}$ which compare signal $KV_{210}$ with reference voltages RA and RB so as to decode signal $KV_{210}$. The outputs from comparators 130 and 130B are applied to an AND gate 133 whose output controls a switch 135. Thus, should comparators 130 and 130B provide a high output, AND gate 133 is enabled and causes switch 135 to be rendered conductive to pass a direct current voltage $V_A$ corresponding to a predetermined value, as signal $E_6$ which corresponds to VI. Similarly, the outputs of comparators 130 and 130C control an AND gate 133A which in turn controls a switch 135A to pass or to block a direct current voltage $V_B$. Similarly, another AND gate 133B is controlled by the outputs from comparators 130A and 130B to control a switch 135B so as to pass or block a direct current voltage $V_C$. Again, an AND gate 133C is controlled by the outputs from comparators 130A and 130C to control a switch 135C to pass or to block a direct current voltage $V_D$. The outputs of switches 135 through 135C are tied together so as to provide a common output.

Figure 8:
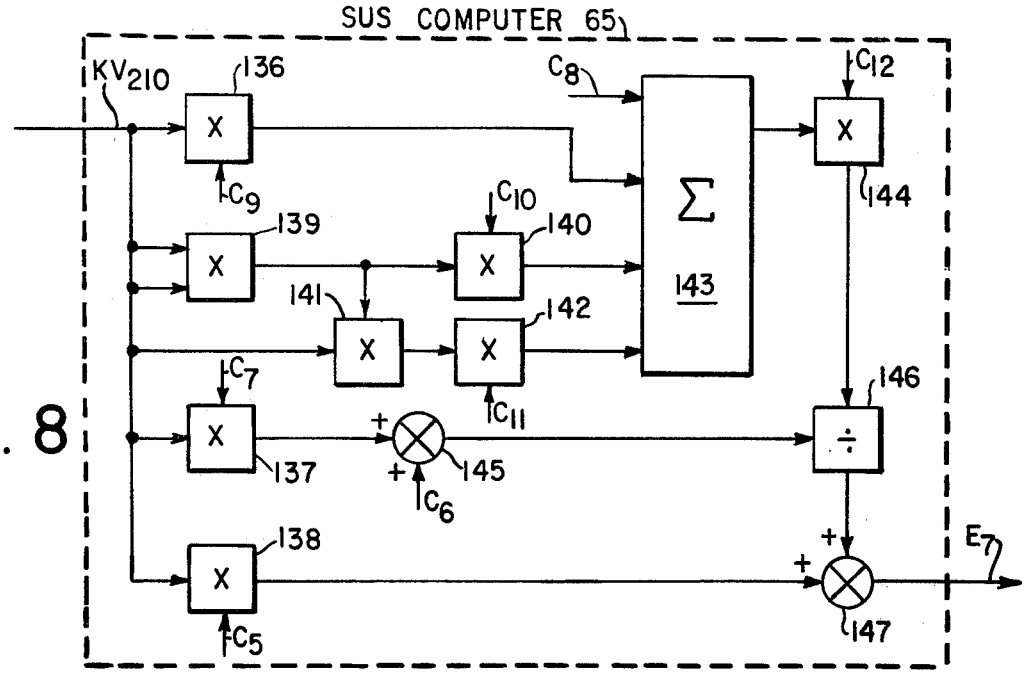

Referring now to FIG. 8, the SUS computer 65 includes multipliers 136, 137 and 138 multiplying signal $KV_{210}$ with direct current voltages $C_9$, $C_7$ and $C_5$, respectively, to provide signals corresponding to the terms $C_9(KV_{210})$, $C_7(KV_{210})$ and $C_5(KV_{210})$, respectively in equation 6. A multiplier 139 effectively squares signal $KV_{210}$ to provide a signal to multipliers 140, 141. Multiplier 140 multiplies the signal from multiplier 139 with a direct current voltage $C_{10}$ to provide a signal corresponding to the term $C_{10}(KV_{210})^2$ in equation 6. Multiplier 141 multiplies the signal from multiplier 139 with signal $KV_{210}$ to provide a signal corresponding to $(KV_{210})^3$. A multiplier 142 multiplies the signal from multiplier 141 with a direct current voltage $C_{11}$ to provide a signal corresponding to the term $C_{11}(KV_{210})^3$ in equation 6. Summing means 143 sums the signals from multipliers 136, 140 and 142 with a direct current voltage $C_8$ to provide a signal to a multiplier 144 where it is multiplied with a direct current voltage $C_{12}$. The signal from multiplier 137 is summed with a direct current voltage $C_6$ by summing means 145 to provide a signal corresponding to the term $[C_6+C_7(KV_{210}]$. A divider 146 divide the signal provided by summing means 145 with the signal provided by multiplier 144 to provide a signal which is summed with the signal from multiplier 138 by summing means 147 to provide signal $E_7$.

Figure 9:
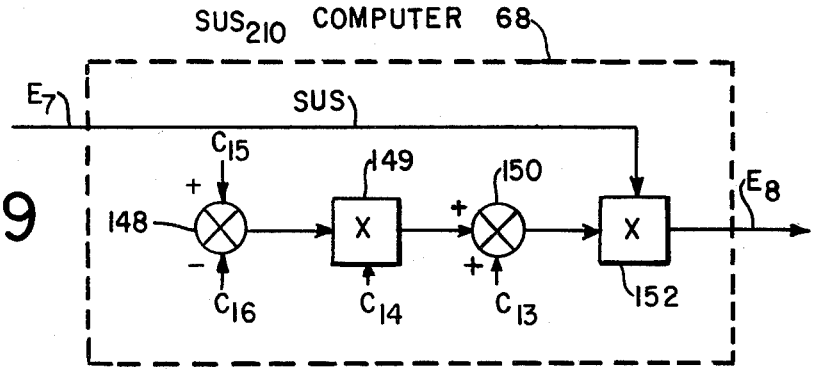

Referring now to FIG. 9, $SUS_{210}$ computer 68 includes subtracting means 148 which subtracts a direct current voltage $C_{16}$ from another direct current voltage $C_{16}$ from another direct current voltage $C_{15}$ to provide a signal corresponding to the term ($C_{15}$-$C_{16}$) in equation 7. The signal from subtracting means 148 is multiplied with a direct current voltage $C_{14}$ by a multiplier 149 to provide a product signal which is summed with another direct current voltage $C_{13}$ by summing means 150. Summing means 150 provides a signal corresponding to the term $[C_{13}+C_{14}(C_{15}-C_{16})]$ in equation 7. The signal from summing means 150 is multiplied with signal $E_7$ by a multiplier 152 to provide signal $E_8$.

Figure 10:
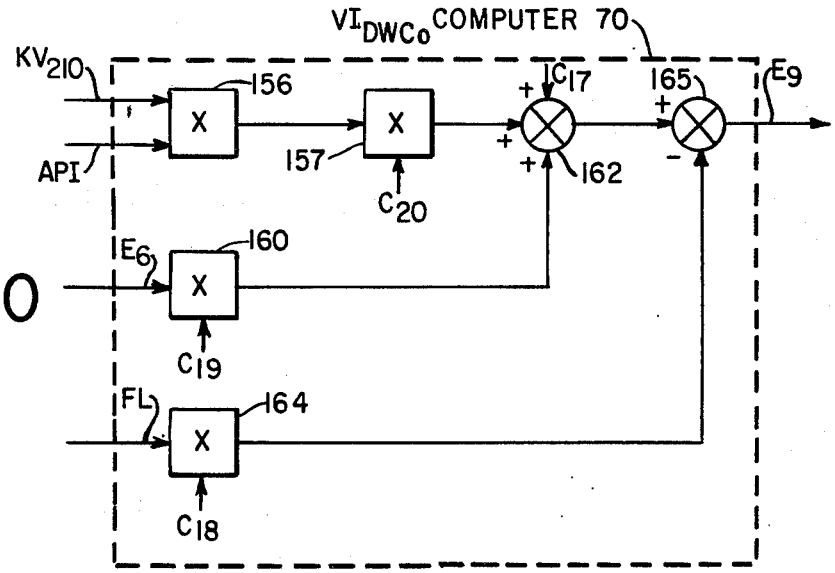

Referring now to FIG. 10, there is shown $VI_{DWCO}$ computer 70 having a multiplier 156 multiplying signals $KV_{210}$ and API to provide a signal corresponding to the term $(KV_{210})$(API) in equation 8. Another multiplier 157 multiplies the signal from multiplier 156 with direct current voltage $C_{20}$ to provide a signal corresponding to the term $C_{20}(KV_{210})$(API). A multiplier 160 multiplies signal $E_6$ with direct current voltage $C_{19}$ to provide a signal corresponding to the term $C_{19}$(VI). Summing means 162 sums the signals from multipliers 157 and 160 with a direct current voltage $C_{17}$ to provide a sum signal. Multiplier 164 multiplies signal FL with direct current voltage $C_{18}$ to provide a signal corresponding to the term $C_{18}$ (FL) in equation 8. Subtracting means 165 subtracts the signals provided by multiplier 164 from the signal provided by summing means 162 to provide signal $E_9$.

Figure 11:
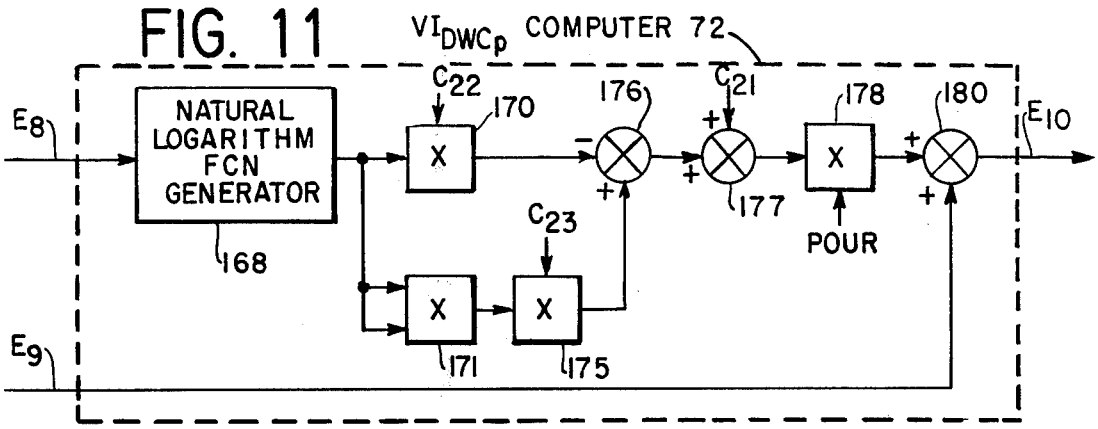

$VI_{DWCP}$ computer 72 show in FIG. 11, includes a natural logarithm function generator 168 receiving signal $E_8$ and providing a signal corresponding to the term $lnSUS_{210}$ to multipliers 170, 171. Multiplier 170 multiplies the signal from function generator 168 with a direct current voltage $C_{22}$ to provide a signal corresponding to the term $C_{22}\ lnSUS_{210}$ in equation 9. Multiplier 171 effectively squares the signal from function generator 168 to provide a signal that is multiplied with the direct current voltage $C_{23}$ by a multiplier 175. Multiplier 175 provides a signal corresponding to the term $C_{23}$ ($lnSUS_{210}$) in equation 9. Subtracting means 176 subtracts the signals provided by multiplier 170 from the signal provided by multiplier 175. Summing means 177 sums the signal from subtracting means 176 with a direct current voltage $C_{21}$. A multiplier 178 multiplies the sum signal from summing means 177 with a direct current voltage POUR to provide a signal which is summed with signal $E_9$ by summing means 180 which provides signal $E_{10}$.

Figure 12:
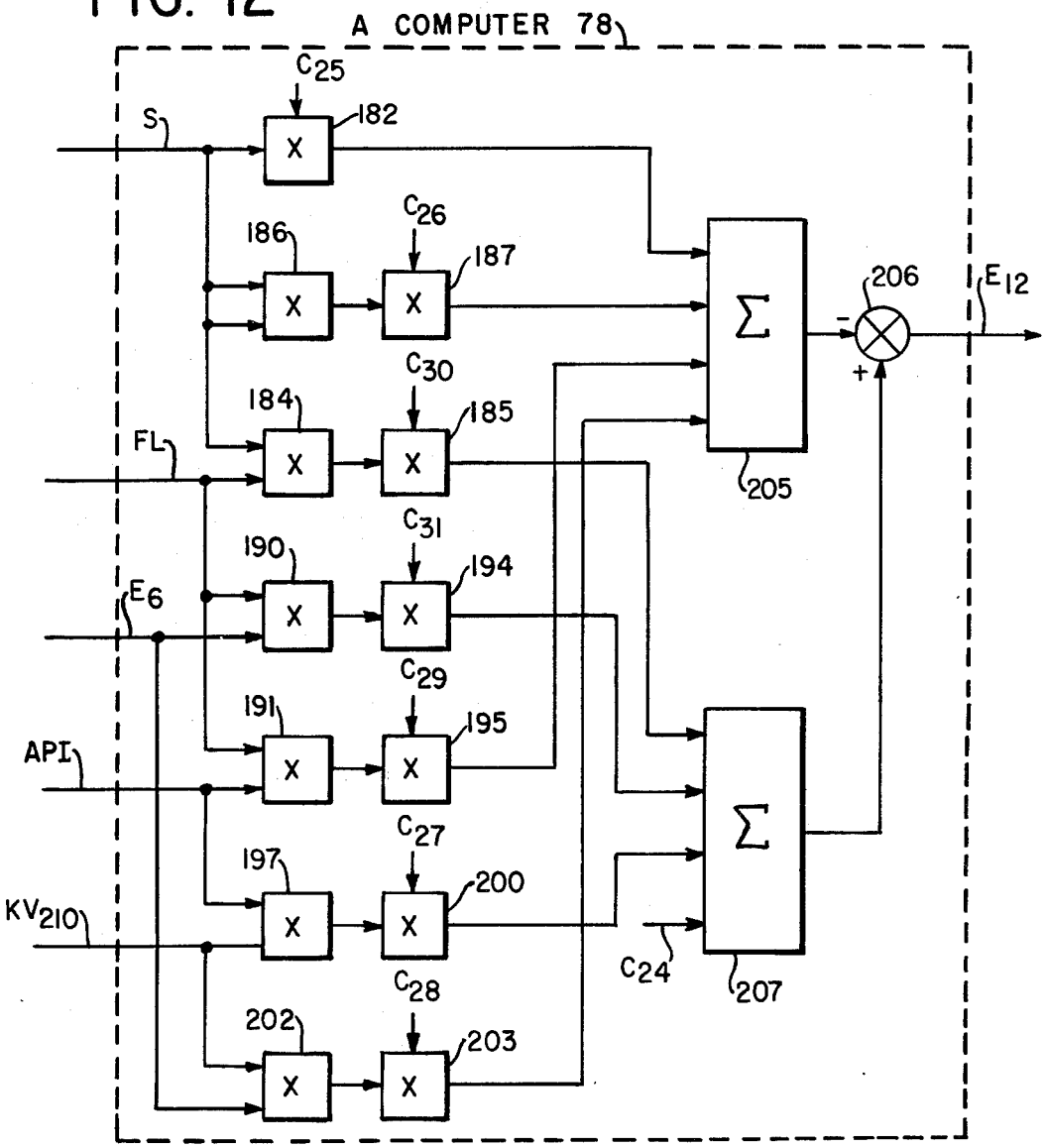

Referring now to FIG. 12, A computer 78 includes multipliers 182, 184 multiplying signal S with a direct current voltage $C_{25}$ and signal FL, respectively, to provide signals corresponding to the term $C_{25}$(S) and (FL)(S), respectively, in equation 11. The signal from multiplier 184 is multiplied with a direct current voltage $C_{30}$ to provide a signal corresponding to the term $C_{30}$ (FL) (S) by a multiplier 185. A multiplier 186 effectively squares signal S and provides it to a multiplier 187 where it is multiplied with a direct current voltage $C_{26}$ to provide a signal corresponding to the term $C_{26}(S)^2$. Signal FL is also applied to multipliers 190, 191 where it is multiplied with signals $E_6$ and API, respectively, to provide product signals to multipliers 194 and 195, respectively. Multipliers 194, 195 multiply the received signals with direct current voltages $C_{31}$ and $C_{29}$, respectively, to provide signals corresponding to the terms $C_{31}$(fL) (VI) and $C_{29}$(FL) (API) in equation 11. Signal API is also multiplied with signal $KV_{210}$ by a multiplier 197 and its product signal is provided to another multiplier 200 where it is multiplied with the direct current voltage $C_{27}$. Multiplier 200 provides a signal corresponding to the term $C_{27}$ ($K_{210}$) (API). A multiplier 202 multiplies signal $E_6$ with signal $KV_{210}$ to provide a signal to a multiplier 203 where it is multiplied with a direct current voltage $C_{28}$. Multiplier 203 multiplies a signal corresponding to the term $C_{28}(KV_{210})$ (VI). Summing means 205 in summing the signals from multipliers 182, 187, 195 and 203 in effect is summing all of the negative terms in equation 11 and provides them to subtracting means 206. Summing means 207 is summing the outputs from multipliers 185, 194 and 200 with a direct current voltage $C_{24}$ in effect is summing all of the positive terms in equation 11 to provide them to subtracting means 206 where the signal from summing means 205 is subtracted from it to provide signal $E_{12}$.

Figure 13:
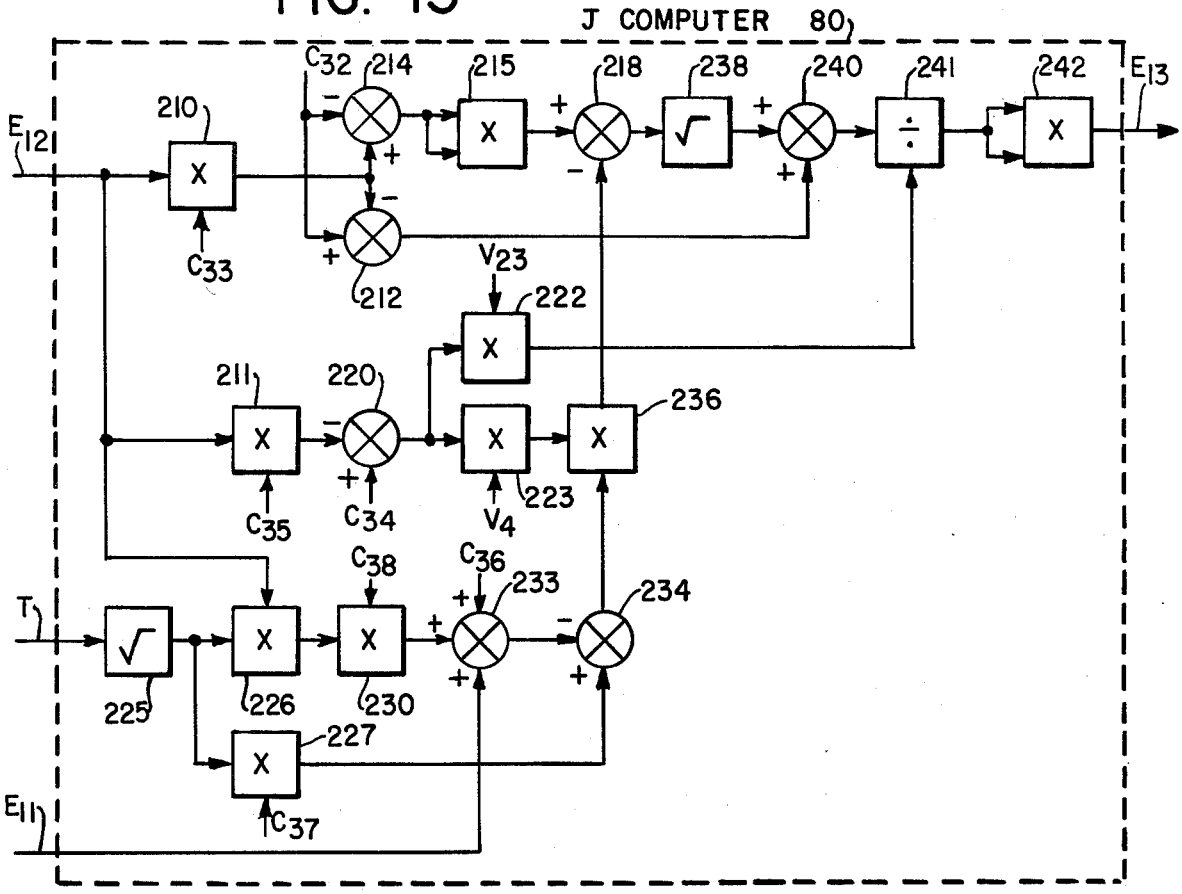

In FIG. 13, J computer 80 includes multipliers 210, 211 multiplying signal $E_{12}$ with direct current voltages $C_{33}$ and $C_{35}$, respectively, to provide signals corresponding to the terms $C_{33}A$ and $C_{35}A$ in equation 12, respectively. The signal from multiplier 210 is subtracted from a direct current voltage $C_{32}$ by subtracting means 212, while subtracting means 214 subtracts voltage $C_{32}$ from the signal provided by multiplier 210. Thus, subtracting means 212, 214 provide signals corresponding to the terms $C_{33}A$-$C_{32}$ and $C_{32}$-$C_{33}A$, respectively, in equation 12. A multiplier 215 effectively squares the signal from subtracting means 214 to provide a signal to subtracting means 218.

The signal provided by multiplier 211 is subtracted from a direct current voltage $C_{34}$ by subtracting means 220 to provide a signal corresponding to the term [$C_{34}$-$C_{35}$(A)] in equation 12. Multipliers 222 and 223 multiply the signal from subtracting means 220 with direct current voltages $V_{23}$ and $V_4$, corresponding the values of 2 and 4, to provide product signals. Signal T is applied to a conventional type square root circuit 225 which provides a signal to multipliers 226, 227 where the signal is multiplied with signal $E_{12}$ and direct current voltage $C_{37}$, respectively. Multipliers 226 and 227 provide signals corresponding to the terms (A) ($\sqrt{T}$) and to $C_{37}\sqrt{T}$, respectively, in equation 12. The signal from multiplier 226 is multiplied with a direct current voltage $C_{38}$ by a multiplier 230 with provides a signal to summing means 233 where it is summed with another direct current voltage $C_{36}$ and a signal $E_{11}$ by summing means 233. Summing means 233 effectively sums the negative terms which are shown as being $-C_{36}$, $-C_{38}$ (A) ($\sqrt{T}$) amd $-\Delta VI$.

Subtracting means 234 subtracts the signal provided by summing means 233 from the signal provided by multiplier 227 to provide a difference signal. A multiplier 236 multiplies the signal from multiplier 223 and subtracting means 234 to provide a signal which is subtracted from the signal provided by multiplier 215 by subtracting means 218. Subtracting means 218 provides a signal to a square root circuit 238 which provides a signal to subtracting means 240. Summing means 240 adds a signal provided by subtracting means 212 to the signal provided by square root circuit 238. A divider 241 divides the signal from multiplier 222 into a signal provided by summing. Dividing means 241 provides a signal that is effectively squared by a multiplier 242 to provide signal $E_{13}$.

The present invention as hereinbefore described controls a furfural refining unit receiving light sweet charge oil to achieve a desired charge oil flow rate for a constant furfural flow rate. It is also within the scope of the present invention, as hereinbefore described, to control the furfural flow rate while the light sweet charge oil flow is maintained at a constant rate.

What is claimed is:

1. A control system for a refining unit having a refining tower receiving light sweet charge oil and furfural and providing raffinate and extract mix which are subsequently processed to recover the furfural and to yield refined oil and extract oil, respectively, comprising gravity analyzer means for analyzing the light sweet charge oil and providing a signal API corresponding to the API gravity of the light sweet charge oil, flash point temperature analyzer means for analyzing the light sweet charge oil and providing a signal FL corresponding to the flash point temperature of the light sweet charge oil, sulfur analyzer means for analyzing the light sweet charge oil and providing a signal S corresponding to the sulfur content of the light sweet charge oil, viscosity analyzer means for analyzing the light sweet charge oil and providing signals $KV_{150}$ and $KV_{210}$ corresponding to the kinematic viscosities of the light sweet charge oil corrected to 150° F. and 210° F., respectively, flow rate sensing means for sensing the flow rates of the light sweet charge oil and the furfural and providing signals CHG and SOLV corresponding to the sensed flow rates of the light sweet charge oil and the furfural, respectively, temperature sensing means for sensing the temperature of the extract mix and providing a signal T corresponding thereto, and control means connected to all the analyzer means, to flow rate sensing means and to the temperature sensing means for controlling one of the flow rates of the light sweet charge oil and the furfural flow rates while maintaining the other flow rate constant in accordance with signals API, FL, S, $KV_{150}$, $KV_{210}$, CHG, SOLV and T.

2. A system as described in claim 1, in which the control means includes VI signal means connected to the viscosity analyzer means for providing a signal VI corresponding to the viscosity index of the light sweet charge oil in accordance with kinematic viscosity signals $KV_{150}$ and $KV_{210}$; $SUS_{210}$ signal means connected to the viscosity analyzer means for providing a signal $SUS_{210}$ corresponding to the charge oil viscosity in Saybolt Universal Seconds corrected to 210° F.; A signal means connected to the viscosity analyzer means, to the sulfur analyzer means, to the flash point temperature analyzer means, to the gravity analyzer means and to the VI signal means for providing a signal A corresponding to an interim factor A in accordance with signals $KV_{210}$, S, FL, API and VI;$\Delta$VI signal means connected to the viscosity analyzer means, to the gravity analyzer means, to the flash point temperature analyzer means, to the VI signal means and to the $SUS_{210}$ signal means and receiving a direct current voltage $VI_{RP}$ corresponding to the viscosity index of the refined oil at the predetermined temperature for providing a signal ΔVI in accordance with signals $KV_{210}$, API, FL, VI and $SUS_{210}$ and voltage $VI_{RP}$, J signal means connected to the ΔVI signal means, to the A signal means and to the temperature sensing means for providing a J signal to the selection means corresponding to a furfural dosage for light sweet charge oil in accordance with the ΔVI signal, signals A and T; control signal means connected to the J signal means and to the flow rate sensing means for providing a control signal in accordance with the J signal and one of the sensed flow rate signals; and apparatus means connected to the control signal means for controlling the one flow rate of the light sweet charge oil and furfural flow rates in accordance with the control signal.

3. A system as described in claim 2 in which the $SUS_{210}$ signal means includes SUS signal means connected to the viscosity analyzer means, and receiving direct current voltages $C_5$ through $C_{12}$ for providing a signal SUS corresponding to an interim factor SUS in accordance with signal $KV_{210}$, voltages $C_5$ through $C_{12}$ and the following equation:

$$SUS=C_5(KV_{210})+[C_6+C_7(KV_{210})]/[C_8+C_9(KV_{210})+C_{10}(KV_{210})^2+C_{11}(KV_{210})^3](C_{12}),$$

where $C_5$ through $C_{12}$ are constants; and $SUS_{210}$ network means connected to the SUS signal means and to the signal means and receiving direct current voltages $C_{13}$ through $C_{16}$ for providing signal $SUS_{210}$ to the Δv]signal means in accordance with signal SUS, voltages $C_{13}$ through $C_{16}$ and the following equation:

$$SUS_{210}=[C_{13}+C_{14}(C_{15}-C_{16})]SUS,$$

where $C_{13}$ through $C_{16}$ are constants.

4. A system as described in claim 3 in which the VI signal means includes K signal means receiving direct current voltages $C_2$, $C_3$, $C_4$ and $T_{150}$ for providing a signal $K_{150}$ corresponding to the kinematic viscosity of the charge oil corrected to 150° F. in accordance with voltages $C_2$, $C_3$, $C_4$ and $T_{150}$, and the following equation:

$$K_{150}=[C_2-IN(T_{150}+C_3]/C_4,$$

where $C_2$ through $C_4$ are constants, and $T_{150}$ corresponds to a temperature of 150° F.; $H_{150}$ signal means connected to the viscosity analyzer means and receiving a direct current voltage $C_1$ for providing a signal $H_{150}$ corresponding to a viscosity H value for 150° F. in accordance with signal $KV_{150}$ and voltage $C_1$ in the following equation:

$$H_{150}=lnln(KV_{150}+C_1),$$

where $C_1$ is a constant; $H_{210}$ signal means connected to the viscosity analyzer means and receiving voltage $C_1$ for providing signal $H_{210}$ corresponding to a viscosity H value for 210° F. in accordance with signal $KV_{210}$, voltage $C_1$ and the following equation:

$$H_{210}=lnln(KV_{210}+C_1),$$

$H_{100}$ signal means connected to the K signal means, to the $H_{150}$ signal means and the $H_{210}$ signal means for providing a signal $H_{100}$ corresponding to a viscosity H value for 100° F. in accordance with signals $H_{150}$, $H_{210}$ and $K_{150}$ and the following equation:

$$H_{100}=H_{210}+(H_{150}-H_{210})/K_{150},$$

$KV_{100}$ signal means connected to the $H_{100}$ signal means and receiving voltage $C_1$ for providing a signal $KV_{100}$ corresponding to a kinematic viscosity for the charge oil corrected to 100° F. in accordance with signal $H_{100}$, voltage $C_1$, and the following equation:

$$KV_{100}=exp[exp(H_{100})]-C_1,$$

and VI memory means connected to the $KV_{100}$ signal means and to the viscosity analyzer means having a plurality of signals stored therein, corresponding to different viscosity index and controlled by signals $KV_{100}$ and $KV_{210}$ to select a stored signal and providing the selected stored signal as signal VI.

5. A system as described in claim 4 in which the A signal means also receives direct current voltages $C_{24}$ through $C_{31}$ and provides signal A in accordance with signals S, $KV_{210}$, API, VI and FL, voltages $C_{24}$ through $C_{31}$ and the following equation:

$$A=C_{24}-C_{25}(S)-C_{26}(S)^2+C_{27}(KV_{210})(API)-C_{28}(KV_{210})(VI)+C_{29}(FL)(API)+C_{30}(FL)(S)+C_{31}(FL)(VI),$$

where $C_{24}$ through $C_{31}$ are constants.

6. A system as described in claim 5 in which the ΔVI signal means includes $VI_{DWCO}$ signal means connected to the flash point temperature analyzer means, to the viscosity analyzer means and to the gravity analyzer means, and to the VI signal means, and receiving direct current voltages $C_{17}$ through $C_{20}$ for providing a first signal $VI_{DWCO}$ corresponding to the viscosity index of the dewaxed charge oil for 0° F. in accordance with signals FL, VI, $KV_{210}$ and API, voltages $C_{17}$ through $C_{20}$ and the following equation:

$$VI_{DWCO}=C_{17}-C_{18}(FL)+C_{19}(VI)+C_{20})KV_{21\text{-}0})(API),$$

where $C_{17}$ through $C_{20}$ are constants; $VI_{DWCP}$ signal means connected to the first $VI_{DWCO}$ signal means and to the $SUS_{210}$ signal means, and receiving direct current voltages $C_{21}$ through $C_{23}$ and Pour, providing a signal $VI_{DWCP}$ corresponding to the viscosity index of the dewaxed charge oil at the predetermined temperature, in accordance with signals $VI_{DWCO}$ and $SUD_{210}$, voltages $C_{21}$ through $C_{23}$ and Pour, and the following equation:

$$VI_{DWCp}=VI_{DWCO}+(POUR)[C_{21}-C_{22}lnSUS_{210}+C_{23}(lnSUS_{212})^2],$$

where Pour is the point of the dewaxed product and $C_{21}$ through $C_{23}$ were contants, subtracting means connected to the $VI_{DWCP}$ means and to the J signal means and receiving voltage $VI_{RP}$ for subtracting voltage $VI_{RP}$ from signal $VI_{DWCO}$ to provide the ΔVI signal to the J signal means.

7. A system as described in claim 6 in which the flow rate of the light sweet charge oil is controlled and the flow of the furfural is maintained at a constant rate and the control signal means receives signal SOLV from the flow rate sensing means, the J signal from the J signal means and a direct current voltage corresponding to a value of 100 and provides a signal C to the apparatus means corresponding to a new light sweet charge oil flow rate in accordance with the J signal, signal SOLV and the received voltage and the following equation:

$$C=(SOLV)(100)/J,$$

so as to cause the flow of the light sweet charge oil to change to the new flow rate.

8. A system as described in claim 6 in which the controlled flow rate is the furfural flow rate and the flow of the light sweet charge oil is maintained constant, and the control signal means is connected to the sensing means, to the J signal means and receives a direct current voltage corresponding to the value of 100 for providing a signal SO to the apparatus means corresponding to a new furfural flow rate in accordance with signals CHG and the J signal and the received voltage, and the following equation:

$$SO=(J)(CHG)/100,$$

so as to cause the furfural flow to change to the new flow rate.

9. A system as described in either claim 7 or claim 8 in which the J signal means receives direct current voltages corresponding to constants $C_{32}$ through $C_{38}$ and provides the J signal in accordance with the received voltages, signals A, T and ΔVI and the following equation:

$$J=\{\{C_{32}-C_{33}A+\{[C_{33}A-C_{32}]^2-4[C_{34}-C_{35}A][-C_{36}+C_{31}\sqrt{T}/-C_{38}(A)(\sqrt{T})-\Delta VI\{\tfrac{1}{2}\{/2[C_{34}-C_{35}(A(]\}^2.$$

* * * * *

UNITED STATES PATENT AND TRADEMARK OFFICE

CERTIFICATE OF CORRECTION

PATENT NO. : 4,169,016

DATED : September 25, 1979

INVENTOR(S) : A. SEQUEIRA, JR.; J. D. BAGNARD; F. L. BARGER

It is certified that error appears in the above-identified patent and that said Letters Patent are hereby corrected as shown below:

Column 9, line 30, "$\Delta$ V]" should read --$\Delta$ VI--

Column 9, line 43, "IN($T_{150}$" should read --ln$T_{150}$--

Column 10, lines 33 and 34, "$C_{20}$)$KV_{21-0}$API)" should read --$C_{20}$($KV_{210}$)(API)--

Column 10, line 42, "$SUD_{210}$" should read --$SUS_{210}$--

Column 10, line 46, "$(\ln SUS_{212})^2$" should read --$(\ln SUS_{210})^2$--

Column 10, line 48, "Pour is the point" should read --Pour is the pour point--

Column 10, line 49, "were" should read --are--

Column 12, line 11, "$C_{31}\sqrt{T}$/" should read --$C_{31}\sqrt{T}$--

Column 12, line 12, "{VI{1/2 " should read -- }VI}$^{1/2}$ --

Column 12, line 12, "$C_{35}$(A(]}$^2$" should read --$C_{35}$(A)]}$^2$--

Signed and Sealed this

Fourth Day of November 1980

[SEAL]

Attest:

SIDNEY A. DIAMOND

Attesting Officer

Commissioner of Patents and Trademarks